United States Patent [19]

Zanzonico

[11] Patent Number: 4,462,624

[45] Date of Patent: Jul. 31, 1984

[54] LATCH DEAD-BOLTING MEANS

[76] Inventor: Rocco Zanzonico, P.O. Box 398, Denville, N.J. 07834

[21] Appl. No.: 495,241

[22] Filed: May 17, 1983

[51] Int. Cl.[3] ..... E05C 19/18

[52] U.S. Cl. ..... 292/258; 292/291

[58] Field of Search ..... 292/291, 293, 294, 289, 292/297, 153, 251, 258, 288, 149, 346

[56] References Cited

U.S. PATENT DOCUMENTS

| | | | |
|---|---|---|---|
| 10,511 | 2/1854 | Webb | 292/292 |
| 95,231 | 9/1869 | Jones | 292/288 |
| 3,773,369 | 11/1973 | Wersonick | 292/288 X |
| 4,189,176 | 2/1980 | Hamilton | 292/153 X |
| 4,285,535 | 8/1981 | Leary | 292/258 X |

*Primary Examiner*—Richard E. Moore

[57] ABSTRACT

In a first embodiment of the invention there is a substantially annular and flat frame for circumscribing a latch, in a door or the like, by interfitting between the latching edge of the door and the door-way frame. The latch-circumscribing frame has a pair of blades formed thereon on the inner surfaces thereof, and a shank portion in which a sharp-pointed rod is threadedly engaged. An outermost end of the rod has a handle fixed thereon whereby with manipulation of the handle, the sharp point of the rod is forceably torqued into arresting engagement with the latch and, simultaneously, draws the blades into incisive engagement with the latch as well. Both the blades and the point of the rod tenaciously clasp the latch therebetween to prevent unauthorized unlatching of the latch. Accordingly, any standard door latch, or the like, can be effectively dead-bolted.

6 Claims, 9 Drawing Figures

LATCH DEAD-BOLTING MEANS

This invention pertains to locking systems and devices, and in particular to dead-bolting means for latches of doors and the like.

There are on the market any number of locking systems, lock assemblies, and locking devices which can be employed to dead-bolt a door or the like. However, such require that the latching means of the door be replaced, or that the conventional latch be supplemented with a further dead-bolting mechanism—usually set into the door in parallel with the conventional latch—for operative retraction into the door, and extension therefrom into a recess provided therefor in the confronting door-frame.

These known, prior art systems, assemblies and devices are most efficient and suitable for their purposes. However, they are somewhat expensive, and require a craftsman's or carpenter's skill to set them into place. Additionally, they remain with the door to which they are fixed, of course. What has been needed, particularly where one's security and privacy is paramount, is a simple, inexpensive, and portable dead-bolting means usable on a standard latch. Having such, one can carry it along on vacations, business trips, etc., and put it to use in motel and hotel rooms, to provide an in-the-room dead-bolting of door latches which can not be compromised by persons outside of the room.

It is an object of this invention to provide a disclosure of just such a long-sought dead-bolting means.

Particularly, it is an object of this invention to set forth means for dead-bolting a standard latch, as aforesaid, comprising a frame having inner and outer, opposite surfaces; said inner surface having means thereon defining at least one blade; said frame further having a threaded channel formed therein; and rod means threadedly engaged with said channel for threaded advance and withdrawal thereof along said channel; wherein said rod means has a leading end and a trailing end; said leading end has means for engaging a latch and arresting the same against movement; and said trailing end has means defining a handle which is manipulatable for threadedly advancing said rod means along said channel, for forcing said leading end into arresting engagement with a latch, and for drawing said blade into incisive engagement with such latch.

Further objects of this invention, as well as the novel features thereof, will become more apparent by reference to the following description, taken in conjunction with the accompanying figures, in which.

Figure 1:
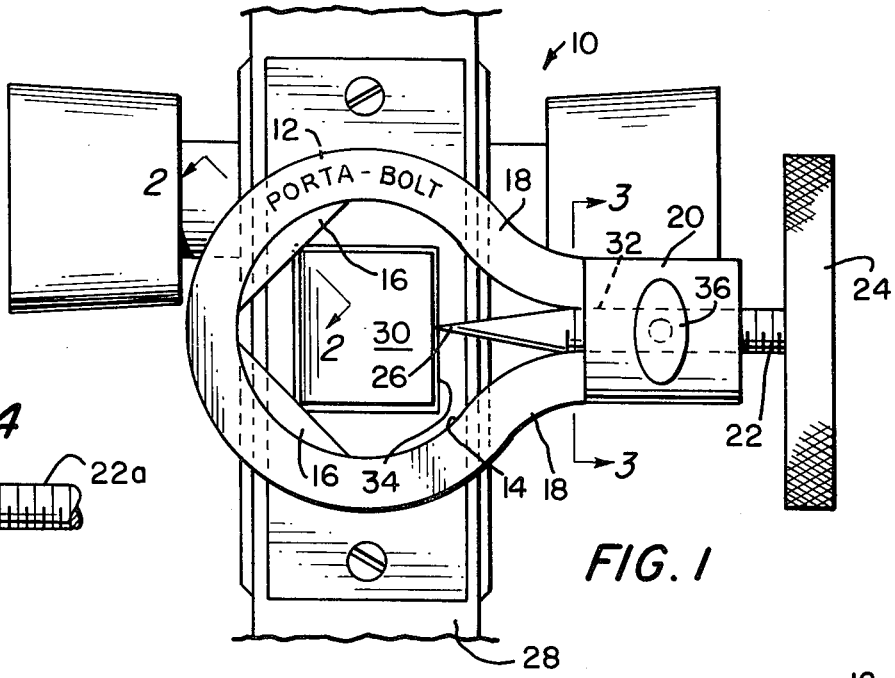
FIG. 1 is an elevational view of an embodiment of the invention, the same being shown in operative association with a portion of a door and a standard latch therefor.

As shown in FIGS. 1–4, dead-bolting means 10, according to a first embodiment of the invention, comprises a frame 12 of substantially circular configuration having an inner surface 14 with blades 16 formed thereon, projecting inwardly. Frame 12 has limbs 18 integral with a shank 20. Shank 20 is centrally bored and threaded to receive threaded rod 22. On its outermost end, rod 22 has a handle 24, and its innermost end is fine-pointed 26.

In use, the dead-bolting means 10 is placed against the latching-edge of a door 28, with the thin frame 12 in circumscription of the latch 30, and the door is closed. As the frame 12 has an inside diameter greater than the outer dimensions of the latch 30, the latch is free to engage the recess provided therefor in the edge of the door-frame (now shown). Hence, the door is latched, in the usual way. Frame 12 is sufficiently thin to fit between the door and door-frame. Now, however, the latch 30 can be dead-bolted by turning the handle 24 to advance the rod 22 along the bore or channel 32 in the shank 20. The fine-point 26 engages the innermost surface 34 of the latch 30, and the blades 16 are drawn into an incisive engagement with the latch 30 while the fine-point 26 proceeds to intrude into surface 34. Latch 30 is tenaciously clasped, or dead-bolted.

Optionally, to hold the rod 22 in that position in which it dead-bolts the latch 30, the dead-bolting means 10 may have a set-screw 36 in operative placement and penetration of the shank 20.

Figure 4:
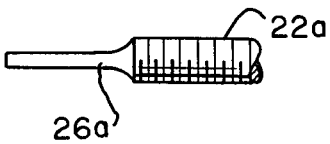
FIG. 4 is a view of only the leading end of an alternative rod.
Figure 3:
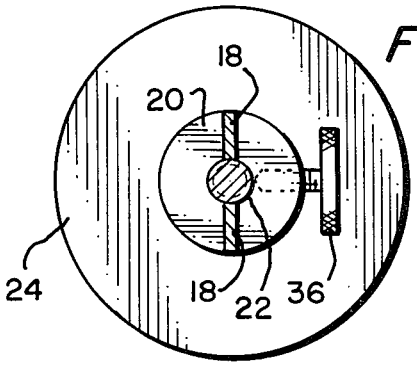
FIG. 3 is a cross-sectional view taken along section 3—3 of FIG. 1.
Figure 2:
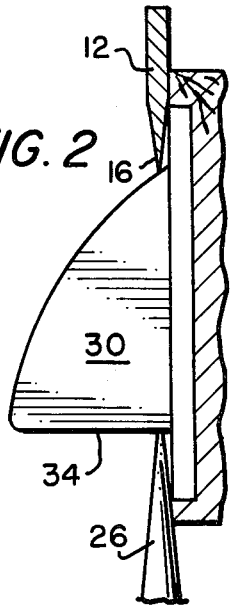
FIG. 2 is a cross-sectional view taken along section 2—2 of FIG. 1.

FIG. 4 discloses an alternative rod 22*a*, or just the leading end thereof, which has a blunt point 26*a* formed thereon. Rod 22*a* could be used in place of rod 22, where there is no wish to pierce the latch 30. When rod 22*a* is used, the blunt end 26*a* bears with such force against the latch 30, that the latter is held frictionally and tends to become cocked or canted in the door.

Figure 5:
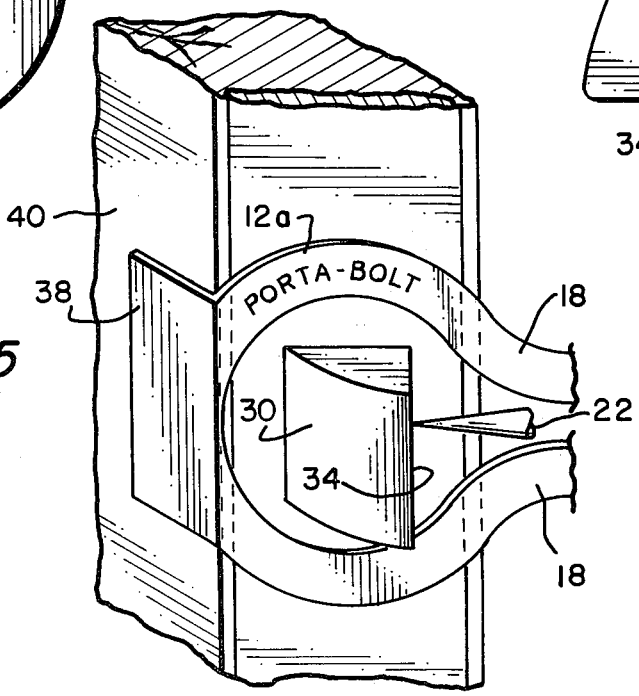
FIG. 5 is a perspective view, similar to FIG. 1, of an alternative embodiment of the invention, showing only a portion thereof.

The alternative embodiment 10*a* of the dead-bolting means shown in FIG. 5 is the same in all respects, beyond the limbs 18, as the embodiment 10 of FIGS. 1–4. However, it has no blades projecting from the inner surface 14 of the frame 12*a*. Rather, it has a right-angularly disposed limb 38 for engaging the planar surface (outer surface, from the perspective of a room) 40 of a door which carries a standard latch 30.

Dead-bolting means 10*a*, like the priorly-described embodiment, is set against the latching-end of a door and the door is shut—to allow the latch 30 to extend therefrom. Then, again, the rod is advanced to the latch surface 34 and forceably torqued thereagainst. The rod 22 advance is reacted by the limb 38.

While I have described my invention in connection with specific embodiments thereof it is to be clearly understood that this is done only by way of example and not as a limitation to the scope of my invention, as set forth in the objects thereof and in the appended claims. For instance, the invention can take the form shown in FIGS. 6 through 9.

The dead-bolting means 10*b* shown in FIGS. 6–9 comprises a thin plate 42 made of steel (or equally durable metal) having an aperture 44. On opposite sides of the aperture are formed mutually confronting blades 46.

Figure 6:
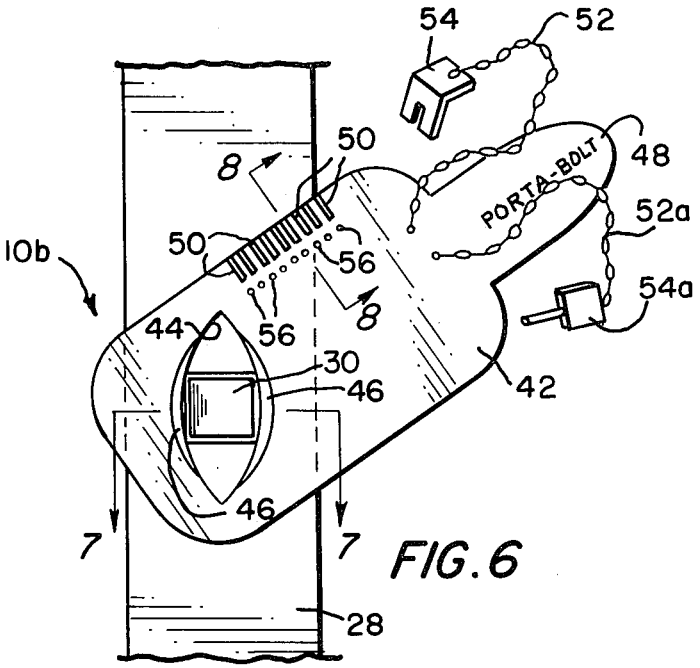
FIG. 6 is an elevational view of a further embodiment of the invention also shown in operative association with a portion of a door and a standard latch therefor.
Figure 7:
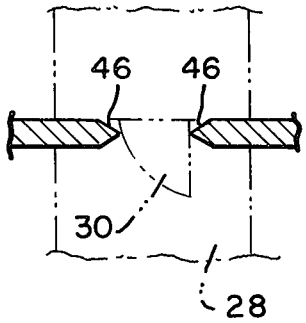
FIG. 7 is a cross-sectional view taken along section 7—7 of FIG. 6.
Figure 8:
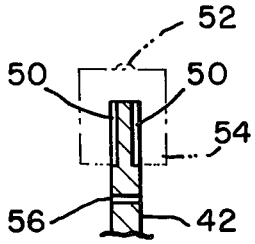
FIG. 8 is a cross-sectional view taken along section 8—8 of FIG. 6.

The aperture 44 has an orientation, relative to its greatest dimension, which is substantially diagonal to the plate 42. The width of the aperture 44, however, is greater than that of the door latch 30. Hence, as described in connection with embodiment 10, the plate 42 is placed against the edge of the door, with the aperture in circumscription of the latch 30—as shown in FIG. 6—and the door 28 is closed.

Figure 9:
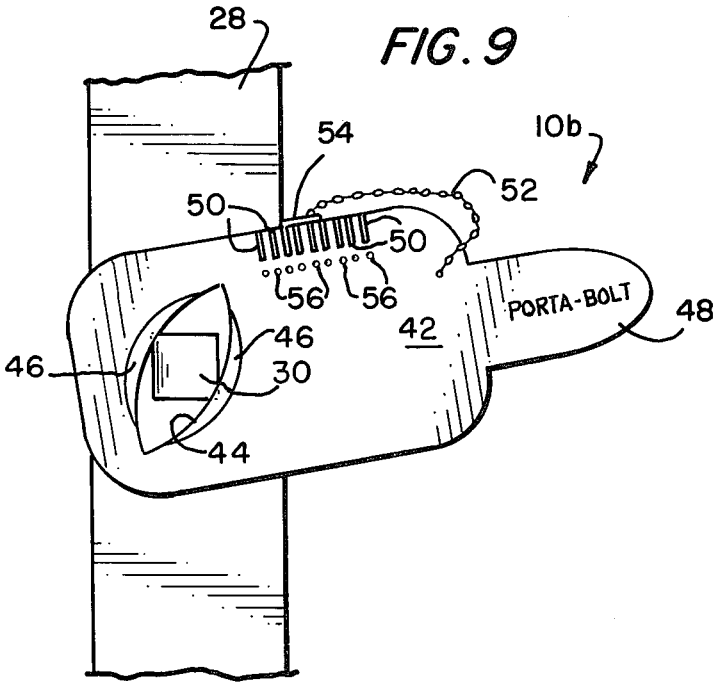
FIG. 9 is an elevational view, like that of FIG. 6, showing the further embodiment in a "dead-bolted" disposition relative to the door latch.

Plate 42 has a hand-grip 48. Therefore, with the door closed, and the aperture 44 diagonally angled about the latch 30, it is only necessary to rotate the plate 42, by means of the hand-grip 48, in a clockwise direction. This brings the blades 46 into incisive clasp of the latch 30. Such clasped, or dead-bolted disposition of the plate 42 is shown in FIG. 9.

In order to retain the plate 42 in dead-bolted clasp of the latch 30, this embodiment of the invention provides keepers. Along the uppermost edge of the plate 42 is a series of slots 50. The latter are formed, in parallel, on each side of the plate edge. Attached to the plate 42 by a chain 52 is a bifurcated keeper 54. When the plate 42 has been turned into a dead-bolting position, as shown in FIG. 9, the bifurcations of the keeper 54 are slidably engaged with the slots 50 which are nearest to the surface of the door. By this means, the plate 42 is secured in dead-bolted disposition; the party who has dead-bolted the door must remove the keeper 54 before the plate 42 can be turned counterclockwise to release the latch 30.

Optionally, or in addition, the dead-bolting means **10*b* can have a series of holes 56 formed adjacent to the uppermost edge of the plate 42. Then, a thin, dowel-ended keeper 54*a*, held by a chain 52*a* to the plate 42, can be used to engage the hole 56 which is nearest to the door surface—when the plate is in its dead-locked disposition. As can be appreciated, the dowel end of the keeper 54*a* is simply passed into the hole 56** which is exposed immediately adjacent to the door surface.

I claim:

1. Means for dead-bolting a standard latch, comprising:

a frame having inner and outer, opposite surfaces;

said inner surface having means thereon defining at least one blade;

said frame further having a threaded channel formed therein; and rod means threadedly engaged with said channel for threaded advance and withdrawal thereof along said channel; wherein said rod means has a leading end and a trailing end;

said leading end has means for engaging a latch and arresting the same against movement; and said trailing end has means defining a handle which is manipulatable for threadedly advancing said rod means along said channel, for forcing said leading end into arresting engagement with a latch, and for drawing said blade into incisive engagement with such latch.

2. Means for dead-bolting a standard latch, according to claim 1, wherein:

said inner surface has a pair of blades formed thereon, in spaced-apart disposition.

3. Means for dead-bolting a standard latch, according to claim 2, wherein:

each blade of said pair thereof has a linear edge; and said edges of said blades are substantially disposed in planes normal to each other.

4. Means for dead-bolting a standard latch, according to claim 2, wherein:

said frame has an arcuate portion for circumscribing a latch, and limbs contiguous with and extending from said arcuate portion, and further has a shank portion joined to said limbs; and said channel is formed in said shank portion.

5. Means for dead-bolting a standard latch, according to claim 1, wherein:

said leading end of said rod means is fine-pointed.

6. Means for dead-bolting a standard latch, according to claim 1, wherein:

said leading end of said rod means is blunt-pointed.

* * * * *